US008596969B2

(12) United States Patent
Chuong et al.

(10) Patent No.: US 8,596,969 B2
(45) Date of Patent: Dec. 3, 2013

(54) AXIAL RETENTION FEATURE FOR GAS TURBINE ENGINE VANES

(75) Inventors: Conway Chuong, Manchester, CT (US); Shelton O. Duelm, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 526 days.

(21) Appl. No.: 12/975,617

(22) Filed: Dec. 22, 2010

(65) Prior Publication Data

US 2012/0163964 A1 Jun. 28, 2012

(51) Int. Cl.
*F03B 1/00* (2006.01)

(52) U.S. Cl.
USPC ..... 415/209.2; 415/209.3

(58) Field of Classification Search
USPC ..... 415/170.1, 173.1, 173.4, 173.5, 173.6, 415/191, 193, 196, 208.1, 208.2, 209.1, 415/209.2, 209.3, 209.4, 211.1, 213.1, 220
See application file for complete search history.

(56) References Cited

U.S. PATENT DOCUMENTS 5,411,369 A * 5/1995 Bouchard ..... 415/189

* cited by examiner

*Primary Examiner* — Edward Look
*Assistant Examiner* — Juan G Flores
(74) *Attorney, Agent, or Firm* — Carlson, Gaskey & Olds, P.C.

(57) ABSTRACT

A case assembly for a gas turbine engine is provided that includes an outer case with circumferentially spaced individual bosses that include a recess. A vane assembly is received in the outer case. An axial retention ring has uninstalled and installed conditions. The axial retention ring outside of the recess is in the uninstalled condition and received in the recess in the installed condition. An anti-rotation feature, such as a ring, is arranged between the bosses in a locking condition to prevent rotation of the axial retention ring between the installed and uninstalled conditions.

18 Claims, 5 Drawing Sheets

AXIAL RETENTION FEATURE FOR GAS TURBINE ENGINE VANES

BACKGROUND

This disclosure relates to a gas turbine engine. More particularly, the disclosure relates to an axial retention feature for turbine vanes.

A gas turbine engine includes one or more compressor sections, a combustor section, and one or more turbine sections. One example turbine section includes an array of turbine vanes that are supported relative to an outer case. The array is typically axially retained relative to the outer case using a single ring that is fastened to the outer case using numerous circumferentially arranged bolts. Alternative retention methods include brackets which increase part weight and cost.

SUMMARY

A case assembly for a gas turbine engine is provided that includes an outer case with circumferentially spaced individual bosses that include a recess. A vane assembly is received in the outer case. An axial retention ring has uninstalled and installed conditions. The axial retention ring outside of the recess is in the uninstalled condition and received in the recess in the installed condition. An anti-rotation ring with a locking feature prevents rotation of the axial retention ring between the installed and uninstalled conditions.

A gas turbine engine case assembly is assembled by installing the axial retention ring onto a circumferential array of turbine vanes. The array is inserted into the outer case. The retaining ring is rotated to axially retain the array relative to the outer case. An anti-rotation ring is inserted axially into the outer case to prevent rotation of the axial retention ring relative to the outer case.

BRIEF DESCRIPTION OF THE DRAWINGS

The disclosure can be further understood by reference to the following detailed description when considered in connection with the accompanying drawings wherein.

DETAILED DESCRIPTION

Figure 1:
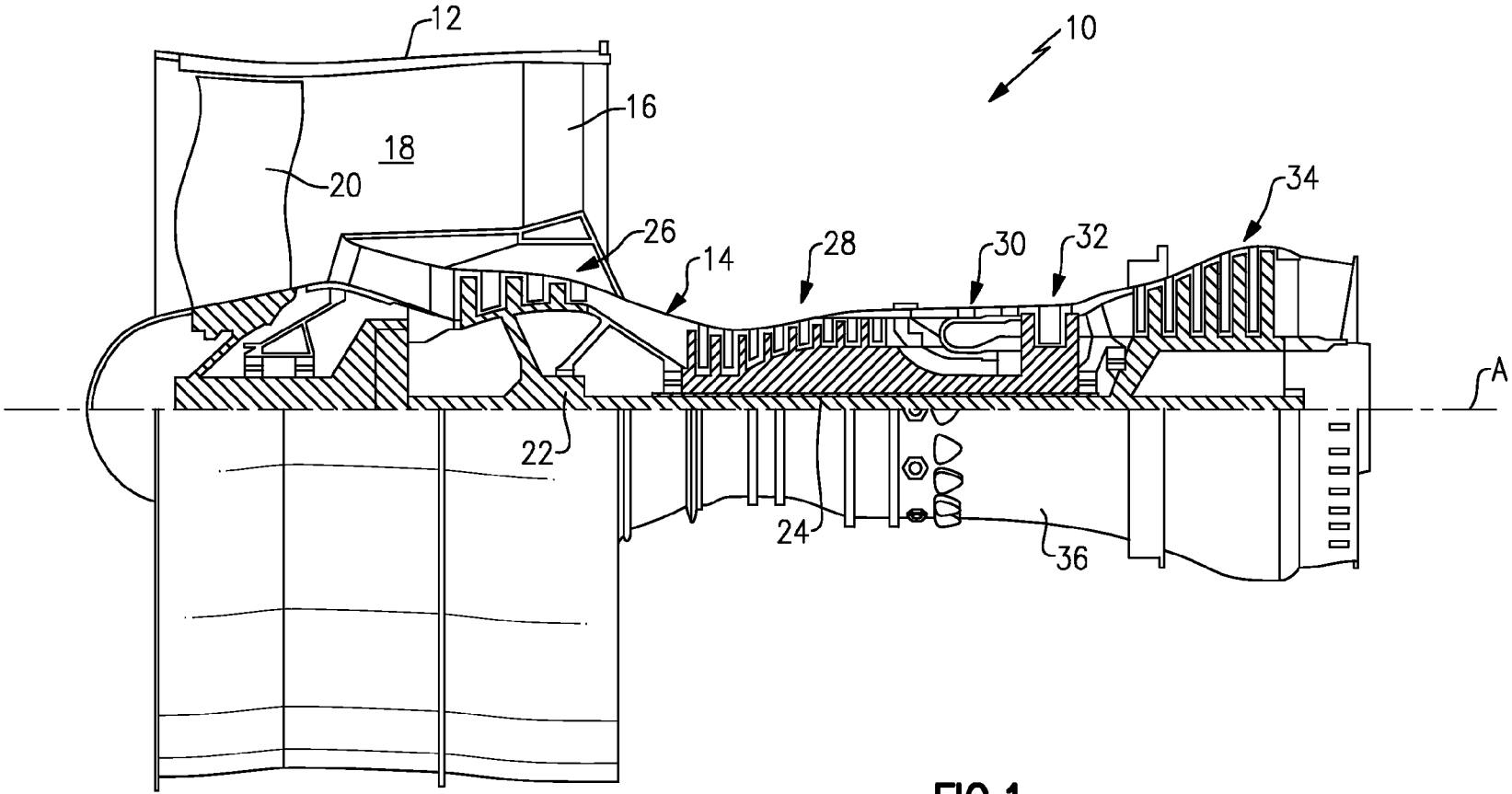
FIG. 1 is a schematic view of an example gas turbine engine.

A gas turbine engine 10 is illustrated schematically in FIG. 1. The gas turbine engine 10 includes a fan case 12 supporting a core 14 via circumferentially arranged flow exit guide vanes 16. A bypass flow path 18 is provided between the fan case 12 and the core 14. A fan 20 is arranged within the fan case 12 and rotationally driven by the core 14.

The core 14 includes a low pressure spool 22 and a high pressure spool 24 independently rotatable about an axis A. The low pressure spool 22 rotationally drives a low pressure compressor section 26 and a low pressure turbine section 34. The high pressure spool 24 supports a high pressure compressor section 28 and a high pressure turbine section 32. A combustor 30 is arranged between the high pressure compressor section 28 and the high pressure turbine section 32.

Figure 2:
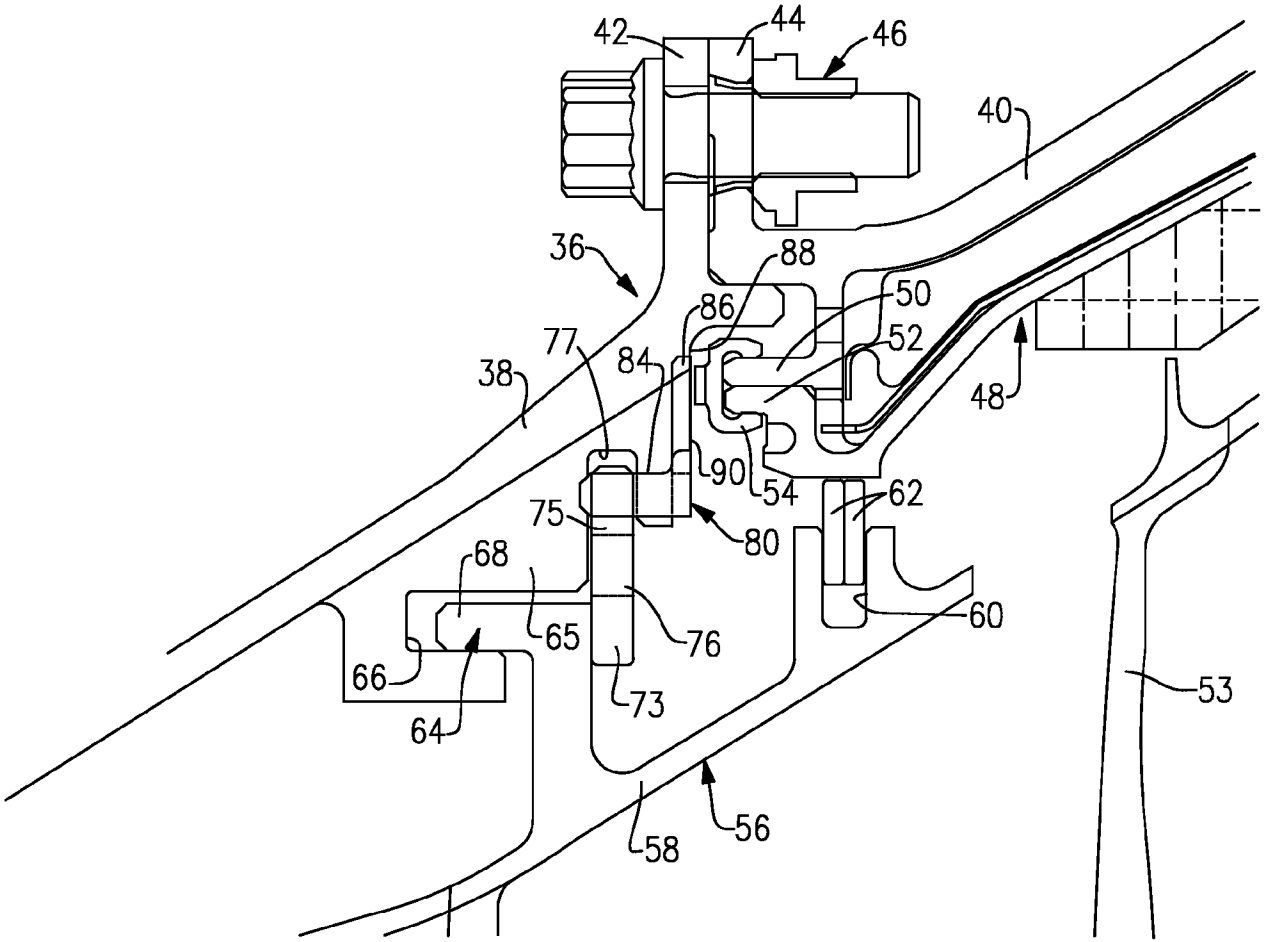
FIG. 2 is a cross-sectional view of a portion of a turbine section of the gas turbine engine illustrated in FIG. 1.

Referring to FIGS. 1 and 2, the core 14 includes a turbine case 36. Referring to FIG. 2, the turbine case 36 includes an outer case having first and second outer case portions 38, 40, which respectively include first and second flanges 42, 44 secured to one another by circumferentially arranged fasteners 46. The second outer case portion 40 includes a blade outer air seal hook 50. A blade outer air seal 48 includes a blade outer air seal flange 52 that is secured to the blade outer air seal hook 50 by an annular clip 54. A turbine blade 53 is housed within the second outer case portion 40 and adjacent to the blade outer air seal 48.

Figure 3B:
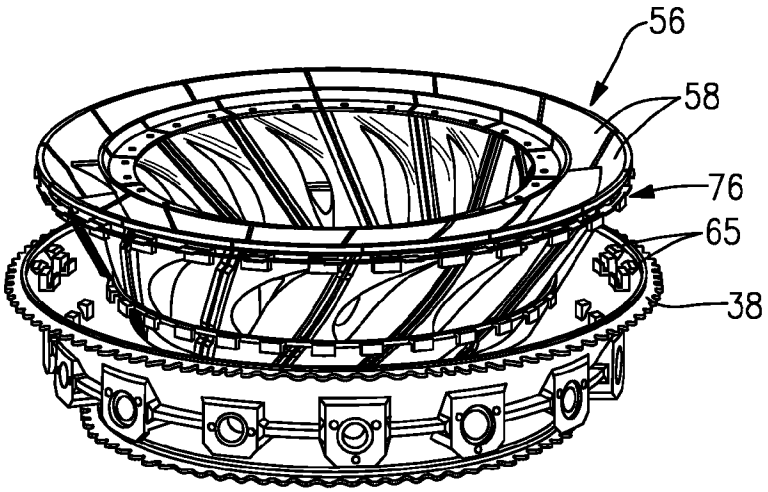
FIG. 3B illustrates the step of inserting the vane array and axial retention ring into an outer case.

Referring to FIGS. 2-3B, a turbine vane assembly 56 is supported within the first outer case portion 38. The turbine vane assembly 56 includes a circumferential array of single or clustered turbine vanes 58 that are free to move relative to one another during temperature gradients within the first outer case portion 38. In the example shown, each turbine vane 58 includes at least one hook 64, in the example a pair of hooks, that support the turbine vane 58 relative to the first outer case portion 38.

The turbine vane assembly 56 includes an annular groove 60 axially downstream from and radially outward of the hooks 64. Seals 62 are received within the annular groove 60 and provide a seal between the turbine vane assembly 56 and the blade outer air seal 48.

Figure 3A:
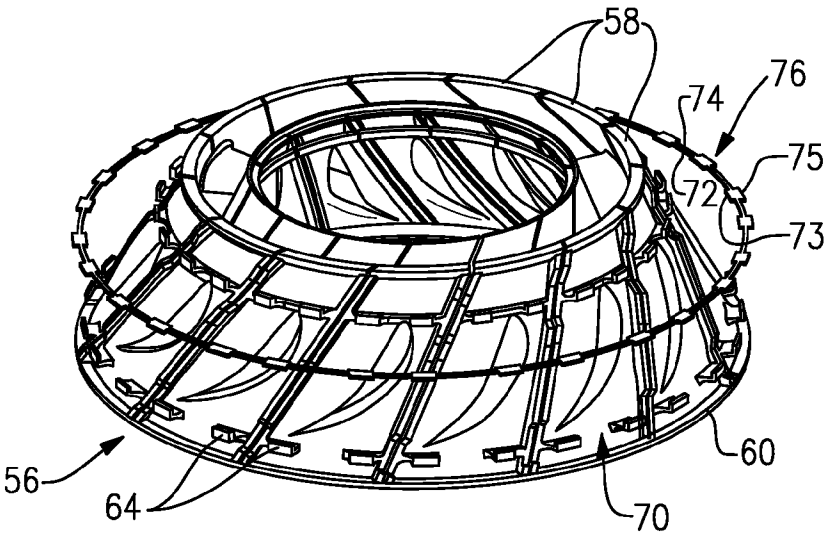
FIG. 3A illustrates assembly of an axial retention ring onto an array of turbine vanes.
Figure 4B:
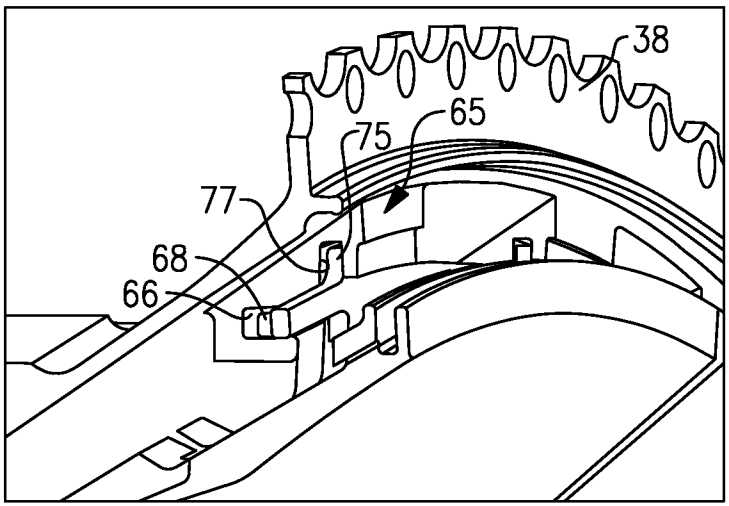
FIG. 4B illustrates the axial retention ring in an installed condition.
Figure 4A:
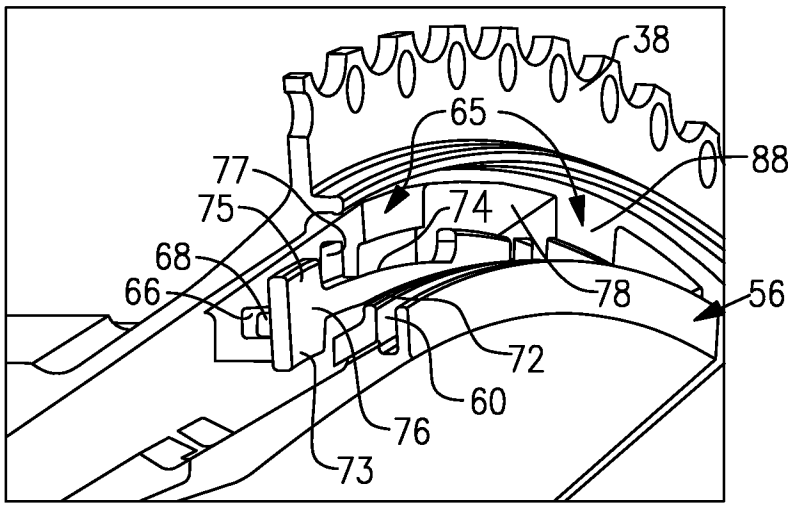
FIG. 4A illustrates the axial retention ring in an uninstalled condition.

The first outer case portion 38 includes circumferentially spaced apart bosses 65 separated by gaps 78, as illustrated in FIGS. 3B and 4A. Traditional turbine cases, including the example, utilize the bosses 65 for the vane hook first recess 66 as well. The first recess 66 receives a leg 68 of the hook 64, best shown in FIG. 2. A space 70 is provided between the hooks, as best shown in FIG. 3A, and the space 70 is circumferentially aligned with a corresponding outer case gap 78 with the turbine vane assembly 56 installed in the first outer case portion 38.

Returning to FIG. 3A, an axial retention ring 76 is used to axially retain the turbine vane assembly 56 relative to the first outer case portion 38. In the example, the axial retention ring includes circumferentially spaced inner and outer tabs 73, 75 respectively separated by inner and outer notches 72, 74 providing a generally scalloped annular body. In this example, the axial retention ring 76 is flat with the inner and outer tabs 73, 75 lying in a common plane. The axial retention ring 76 may be laser-cut from a plate of nickel alloy material, for example.

The outer case is assembled by installing the axial retention ring 76 over the hooks 64. The inner tabs 73 are circumferentially aligned with the spaces 70 such that the axial retention ring 76 may be slid axially past the hooks 64 toward the annular groove 60 to the position illustrated in FIG. 3B. The turbine vane assembly 56 is then inserted into the first outer case portion 38 such that the legs 68 are received in the first recess 66. The axial retention ring 76 is positioned such that the outer tabs 75 are circumferentially aligned with the corresponding gaps 78 when inserting the turbine vane assembly 56 into the first outer case portion 38, as illustrated in FIG. 4A.

Figure 5B:
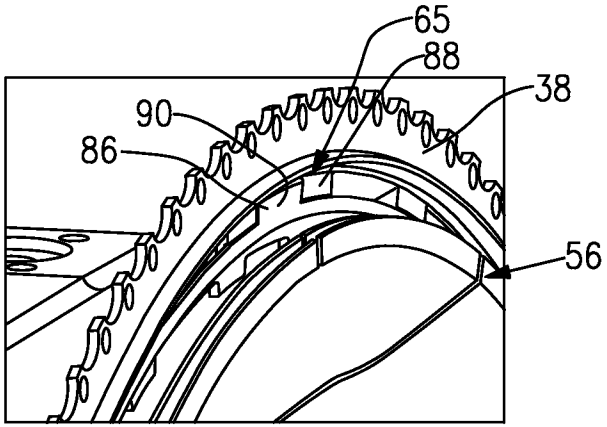
FIG. 5B illustrates the anti-rotation ring installed into the case assembly in a locked condition.
Figure 5A:
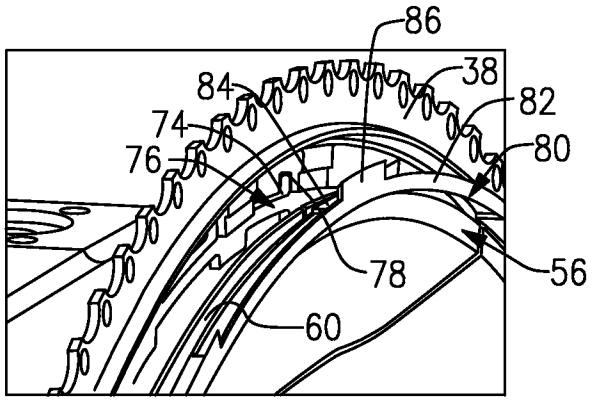
FIG. 5A illustrates an anti-rotation ring prior to insertion into the case assembly.
Figure 5C:
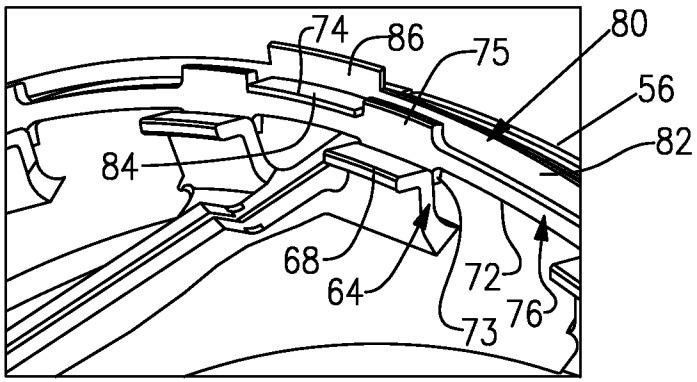
FIG. 5C is a perspective view of the array (outer case not included for clarity) with the axial retention ring in the installed condition and the anti-rotation ring inserted in the locked condition to prevent relative rotation of the axial retention ring.

The axial retention ring is rotated from the uninstalled condition, illustrated in FIG. 4A, to the installed condition, illustrated in FIG. 4B, such that the outer tabs 75 are received in a corresponding second recess 77 of each boss 65. In this manner, the turbine vane assembly 56 is axially retained relative to the first outer case portion 38. To ensure that the axial retention ring 76 does not rotate from the installed condition to the uninstalled condition during engine operation, an anti-rotation feature is required. In the example, the anti-rotation feature is provided by an anti-rotation ring 80 inserted into the gap 78, as illustrated in FIGS. 5A-5C.

The anti-rotation ring 80 is provided by an annular body 82 having first and second projections 84, 86 circumferentially arranged about the annular body 82 and positioned transverse to one another. In the example, the second projections and the annular body 82 lie in a common plane such that the second projections 86 extend radially outwardly from the annular body 82. The first projections 84 extend in an axial direction at a 90° angle from the second projections 86. With the anti-rotation ring positioned in a locked condition, as illustrated in FIG. 5B, the first projections 84 are received in the gap 78 between the bosses 65 and in interlocking relationship with the outer notches 74 of the axial retention ring 76. The second projections include a surface 90 that is generally flush with a face 88 of the boss 65 in the locked condition. The anti-rotation ring 80 is press-fit into a groove in the outer case boss 65, to prevent the anti-rotation ring 80 from loosening from the first outer case portion 38 during module assembly, and prior to assembly to the second outer case portion 40. With the first and second outer case portions 38, 40 fastened to one another, the clip 54 is in close or abutting relationship with the anti-rotation ring 80 to prevent the anti-rotation ring from backing out of the gap 78.

Although an example embodiment has been disclosed, a worker of ordinary skill in this art would recognize that certain modifications would come within the scope of the claims. For that reason, the following claims should be studied to determine their true scope and content.

What is claimed is:

1. A case assembly for a gas turbine engine comprising:

an outer case having circumferentially spaced apart bosses including a recess;

a vane assembly received in the outer case;

an axial retention ring having uninstalled and installed conditions, the axial retention ring outside of the recess in the uninstalled condition and received in the recess in the installed condition; and an anti-rotation feature having a locked condition preventing rotation of the axial retention ring between the installed and uninstalled conditions.

2. The case assembly according to claim 1, wherein a gap is provided between adjacent bosses, and the anti-rotation feature includes a ring having a first projection received in the gap.

3. The case assembly according to claim 2, wherein the anti-rotation ring includes a second projection transverse to the first projection.

4. The case assembly according to claim 3, wherein the boss includes a face and the second projection includes a surface generally flush with the face.

5. The case assembly according to claim 2, wherein the boss includes first and second recesses, and the vane assembly includes a hook received in the first recess, and the axial retention ring is received in the second recess in the installed condition.

6. The case assembly according to claim 5, wherein the axial retention ring includes inner and outer circumferential tabs, the inner tabs abut the hooks and the outer tabs are received in the second recess in the installed condition.

7. The case assembly according to claim 6, wherein a space is provided between adjacent hooks, and the inner tabs are circumferentially aligned with the space in the uninstalled condition.

8. The case assembly according to claim 7, wherein a gap is provided between adjacent bosses, and the spaces and gaps are circumferentially aligned with one another.

9. The case assembly according to claim 2, wherein the axial retention ring is rotatable about an axis between first and second circumferential positions respectively corresponding to the uninstalled and installed conditions.

10. The case assembly according to claim 2, wherein the outer case is provided by a first outer case portion, and comprising a second outer case portion secured to the first outer case portion, the second outer portion including a structure axially abutting the anti-rotation ring in an assembled condition.

11. The case assembly according to claim 10, comprising a blade outer air seal secured to the second outer case portion by a clip, the clip abutting the anti-rotation ring in the assembled condition.

12. The case assembly according to claim 11, wherein the vane assembly includes an annular groove, and a seal is provided in the annular groove and extends to the blade outer air seal.

13. A method of assembling a gas turbine engine case comprising the steps of:

installing an retention ring onto a circumferential array of turbine vanes;

inserting the array into an outer case;

rotating the retention ring to axially retain the array relative to the outer case; and preventing relative rotation of the retention ring relative to the outer case, wherein the preventing step includes inserting an anti-rotation ring into the outer case.

14. The method according to claim 13, wherein the installing step includes circumferentially aligning the hooks of the turbine vanes and inner tabs of the retention ring.

15. The method according to claim 14, wherein the array inserting step includes supporting the hooks in bosses of the outer case.

16. The method according to claim 15, wherein the rotating step includes rotating outer tabs into a recess of the boss and the inner tabs to axially abut the hook in an installed condition.

17. The method according to claim 16, wherein the anti-rotation ring inserting step includes inserting projections between the bosses.

18. The method according to claim 17, comprising the step of fastening another case to the outer case to axially retain the anti-rotation ring in a locked condition.

* * * * *